US006254456B1

(12) United States Patent
Kirchner et al.

(10) Patent No.: US 6,254,456 B1
(45) **Date of Patent: *Jul. 3, 2001**

(54) MODIFYING CONTACT AREAS OF A POLISHING PAD TO PROMOTE UNIFORM REMOVAL RATES

(75) Inventors: Eric J. Kirchner, Troutdale; Jayashree Kalpathy-Cramer, West Linn, both of OR (US)

(73) Assignee: LSI Logic Corporation, Milpitas, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/938,099

(22) Filed: Sep. 26, 1997

(51) Int. Cl.[7] ..... B24B 1/00

(52) U.S. Cl. ..... 451/41; 451/527; 451/530; 451/537; 451/921; 451/526; 451/528

(58) Field of Search ..... 451/41, 527, 530, 451/537, 921, 526–28, 550, 548

(56) References Cited

U.S. PATENT DOCUMENTS 5,177,908 * 1/1993 Tuttle ..... 451/921
5,297,364 * 3/1994 Tuttle ..... 451/527
5,329,734 * 7/1994 Yu ..... 451/527
5,489,233 2/1996 Cook et al. .
5,645,469 * 7/1997 Burke et al. ..... 451/527
5,725,420 * 3/1998 Torii ..... 451/41
5,835,226 11/1998 Berman et al. .
5,876,271 * 3/1999 Oliver ..... 451/41
5,882,251 * 3/1999 Berman et al. ..... 451/527
5,888,121 3/1999 Kirchner et al. .
5,888,251 3/1999 Berman et al. .
5,921,855 * 7/1999 Osterheld et al. ..... 451/527

* cited by examiner

*Primary Examiner*—Joseph J. Hail, III
*Assistant Examiner*—George Nguyen
(74) *Attorney, Agent, or Firm*—Beyer Weaver & Thomas

(57) ABSTRACT

A polishing pad surface having a surface designed for chemical mechanical polishing of a substrate surface is described. The polishing pad surface includes a first area on the surface exposed to and capable of contacting a first amount of the substrate surface during chemical-mechanical polishing and a second area on the surface exposed to and capable of contacting a second amount of the substrate surface during chemical-mechanical polishing, wherein the second amount is larger than the first amount of the substrate surface to produce a more uniformly polished substrate surface.

10 Claims, 8 Drawing Sheets

MODIFYING CONTACT AREAS OF A POLISHING PAD TO PROMOTE UNIFORM REMOVAL RATES

BACKGROUND OF THE INVENTION

The present invention relates to polishing pads used for chemical-mechanical polishing of substrates. More particularly, the present invention relates to modified contact areas on a polishing pad surface to produce a more uniformly polished substrate surface.

Chemical mechanical polishing (sometimes referred to as "CMP") typically involves mounting a substrate faced down on a holder and rotating the substrate face against a polishing pad mounted on a platen, which in turn is rotating or is in orbital state. A slurry containing a chemical component that chemically interacts with the facing substrate layer and an abrasive component that physically removes that layer is flowed between the substrate and the polishing pad or on the pad near the substrate. In semiconductor wafer fabrication, this technique is commonly applied to planarize various wafer layers such as dielectric layers, metallization layers, etc.

FIG. 1 shows a wafer 12 undergoing CMP on a surface of a rotating polishing pad 10 used in a conventional CMP system, such as an Avanti 472, commercially available from Integrated Processing Equipment Corporation (IPEC) of Phoenix, Ariz.. In such conventional CMP systems, polishing pad 10 typically rotates during CMP about an axis that is perpendicular to and passes through a center point of the polishing pad surface and although it is not necessary, wafer 12 may rotate in the same direction. A rotating wafer 12 carves out on polishing pad 10 a wafer track area, which is defined by an inner boundary 16 and an outer boundary 14. Those skilled in the art will recognize that the width of the wafer track area might be larger than the diameter of the wafer because during CMP, the rotating wafer also oscillates from side to side in a radial direction of the polishing pad. FIG. 1 shows a wafer 12 in its displaced, oscillating position 12'. Thus, in the conventional CMP systems, the wafer is polished on the wafer track area of the polishing pad. FIG. 2A shows a front view of a polishing pad 20, e.g., 1C 1000 available from Rodel of Newark, Del., that is employed in modem CMP systems, such as the AvantGaard 676 also available from Integrated Processing Equipment Corporation (IPEC). A surface of polishing pad 20 includes a plurality of macrogrooves 22, microgrooves 24 and slurry injection holes 26. Macrogrooves 22 are shown in an X-Y configuration, i.e. vertical and horizontal macrogrooves intersect at various points to form a "grid", microgrooves 24 are oriented substantially diagonally relative to macrogrooves 22 and slurry injection holes 26 are positioned at various intersections of the vertical and horizontal macrogrooves 22. Those skilled in the art will recognize that the macrogrooves formed on the polishing pad surface are not limited to any particular configuration and may be obtained by a polishing pad manufacturer in other configurations, such as a spiral configuration.

FIG. 2B shows a cross-sectional view of a macrogroove 22 of FIG. 2A, which macrogroove is shaped like a square channel with sharp comers having a width (labeled "w") and a depth (labeled "d"). Macrogrooves 22 of FIG. 2A have a substantially uniform width and depth (of about 1 mm) throughout the substrate surface. The term "macrogroove spacing," as used herein refers to a space on the polishing pad surface separating two parallel and adjacent macrogrooves. For macrogrooves in an X-Y configurations as shown in FIG. 2A, macrogrooves spacings 22 are typically between about 5 and about 6 mm and substantially uniform throughout the polishing pad surface.

During a typical CMP process, polishing pad 20 does not rotate, but orbits around an axis that is perpendicular to the polishing pad surface. FIG. 2C shows a polishing pad 20 (macrogrooves 22, microgrooves 24 and slurry injection holes 26 are not shown to simplify illustration) of FIG. 2A in its orbital state and for exemplary purposes, reference number 20' denotes one position of polishing pad 20 as it orbits around an axis that is perpendicular to the polishing pad surface. In other words, during the orbital motion of the polishing pad, a center point 28 of polishing pad 20 moves in a circular path, as shown in FIG. 2C. Wafer 12 subjected to CMP on orbiting polishing pad 20 is positioned off-center, i.e. the center-point of wafer 12 does not coincide with the center point of polishing pad 20, but is near to the center-point of polishing pad 20. In the modern CMP systems, therefore, a wafer surface mostly contacts the center area of the polishing pad during CMP.

After polishing a significant number of wafers on the same polishing pad, e.g., the polishing pad of FIGS. 1 or 2A, the part of the polishing pad that contacts a center region of the wafer deteriorates to a greater extent than other regions of the polishing pad. By way of example, in FIG. 1, a center region of the wafer track deteriorates to a greater extent than other areas of the polishing pad. As a further example, a center region of the polishing pad of FIG. 2A deteriorates similarly to a greater extent. This deterioration is attributed primarily to a constant down force applied by the wafer during CMP.

Unfortunately, well before the end of a production lot draws near, the degraded polishing pad surface causes the wafers subjected to CMP to experience a slower film removal rate at the center region of the wafer relative to the edge or peripheral regions of the wafer surface, which phenomenon is known in the art as "center slow polishing." "Production lot" refers to a collection of wafers that are fabricated as a group under substantially similar conditions and may ultimately be sold. Center slow polishing is undesirable because it leads to a non-uniformly polished wafer surface, i.e. the center region of the wafer surface is not polished to the same extent as the peripheral region of the wafer. This prematurely ends the life of the polishing pad. In a typical wafer fabrication facility, where several CMP apparatus are employed, the replacement cost of polishing pads can be significant.

What is therefore needed is an improved polishing pad design for producing a uniformly polished substrate surface.

SUMMARY OF THE INVENTION

To achieve the foregoing, the present invention provides a polishing pad surface having a surface designed for chemical mechanical polishing of a substrate surface. The polishing pad surface includes a first area on the surface exposed to and capable of contacting a first amount of the substrate surface during chemical-mechanical polishing and a second area on the surface exposed to and capable of contacting a second amount of the substrate surface during chemical-mechanical polishing, wherein the second amount is larger than the first amount of the substrate surface to produce a more uniformly polished substrate surface.

By way of example, in polishing pads used in conventional CMP systems, macrogrooves are present on the first area, but not on the second area. The macrogrooves may have a width that is between about 1 mm. The macrogrooves may extend radially or may be arranged in a circular configuration at an inner and outer boundary of a wafer track on the polishing pad.

In one embodiment, in a modified polishing pad of the present invention employed in the modem CMP system, the first area has a first set of macrogrooves and the second area has a second set of macrogrooves, wherein the first set of macrogrooves have a larger width than the second set of macrogrooves. The first set of macrogrooves may have a width that is between about 1 and about 2 mm and the second set of macrogrooves may have a width that is between about 0.5 and about 1 mm.

In another embodiment, in the modified polishing pad of the present invention, the first area has a first set of macrogrooves and the second area has a second set of macrogrooves, wherein spacings between the first set of macrogrooves that are adjacent and parallel are narrower than spacings between the second set of macrogrooves that are adjacent and parallel. The spacings between the first set of macrogrooves may be between about 3 and about 5 mm and the spacings between the second set of macrogrooves may be between about 5 and about 8 mm.

The polishing pad of the present invention may be made from at least one of polyurethane, urethane, polymer, felt or filler material. The polishing pad may further include microgrooves and slurry injection holes.

In another aspect, the present invention provides a process for chemical mechanical polishing a substrate surface. The process includes: (1) providing a polishing pad including a first area on the surface exposed to and capable of contacting a first amount of the substrate surface during chemical-mechanical polishing and a second area on the surface exposed to and capable of contacting a second amount of the substrate surface during chemical-mechanical polishing, wherein the second amount is larger than the first amount of the substrate surface to produce a more uniformly polished substrate surface; and (2) polishing on the polishing pad.

The modified polishing pad of the present invention employed in the above mentioned process may further includes macrogrooves, which are present on the first area, but not on the second area. In one embodiment, the first area of the polishing pad of the present invention may have a first set of macrogrooves and the second area may have a second set of macrogrooves such that the first set of macrogrooves have a larger width than the second set of macrogrooves. In another embodiment, the first area of the polishing pad of the present invention has a first set of macrogrooves and the second area has a second set of macrogrooves, wherein spacings between the first set of macrogrooves that are parallel and adjacent are narrower than spacings between the second set of macrogrooves that are parallel and adjacent.

In yet another aspect, the present invention provides a process of substantially uniformly polishing a substrate surface. The process includes determining an overpolished region of a substrate surface, determining the area of the polishing pad that contacts the overpolished region of the substrate surface during chemical-mechanical polishing, and modifying the area of the polishing pad by reducing area exposed to and capable of contacting the substrate surface during chemical-mechanical polishing.

In the polishing pads employed in the conventional CMP systems, the step of modifying may include forming macrogrooves on the first area without forming the macrogrooves in the second area. In the polishing pads employed in modem CMP systems, the step of modifying may include forming a first set of macrogrooves on the first area and forming a second set of grooves on the second area such that the first set of macrogrooves have a larger width than the second set of macrogrooves. Alternatively, in these polishing pads, the step of modifying may include forming a first set of macrogrooves on the first area and forming a second set of grooves on the second area such that spacings between the first set of macrogrooves that are parallel and adjacent are narrower than spacings between the second set of macrogrooves that are parallel and adjacent. The step of modifying may be carried out using a router blade to scive at least a portion of the polishing pad. The process of forming a uniformly polished substrate surface may further include a step of polishing a substrate surface on the modified polishing pad surface.

The present invention represents a marked improvement over the conventional polishing pad design. By way of example, as mentioned above the modified polishing pad design of the present invention produces a more uniformly polished substrate surface, which translates into a higher yield for the polished substrates. As another example, the modified polishing pad design of the present invention prolongs the polishing pad life and therefore reduces the significant replacement cost of the polishing pads.

These and other features of the present invention will be described in more detail below in the detailed description of the invention and in conjunction with the following figures.

DETAILED DESCRIPTION OF THE PREFERRED EMBODIMENTS

The present invention provides modified contact areas on a polishing pad surfaces to produce a more uniformly polished substrate surface. In the following description, numerous specific details are set forth in order to fully illustrate a preferred embodiment of the present invention. It will be apparent, however, that the present invention may be practiced without limitation to some specific details presented herein.

The present invention produces a more uniformly polished substrate surface by exposing less polishing pad surface in a first contact area (hereinafter referred to as "first area") than a second contact area (hereinafter referred to as "second area"). The term "contact area" used in connection with the description of this invention refers to an area of the polishing pad surface that contacts a substrate surface during CMP. The present invention realizes that by placing macrogrooves, or placing relatively wide macrogrooves, or narrowing macrogroove spacing (i.e. decreasing the space separating two parallel and adjacent macrogrooves) in a contact area, the amount of polishing pad surface in that contact area exposed to contact the substrate surface during CMP is reduced. The first area of the polishing pad surface, according to the present invention, contacts a region of the substrate surface that is typically overpolished when polished by the polishing pads currently employed in the conventional and modem CMP systems.

Stated another way, the present invention provides a polishing pad having two areas: a first area where the polishing pad wears at a relatively low rate during its intended operation; and a second area where the polishing pad wears at a relatively high rate. The first area is characterized by a first ratio of surface area actually contacting the substrate per unit area of the polishing pad surface (including macrogrooves, for example) and the second area is characterized by a second ratio of surface area actually contacting the substrate per unit area of polishing pad surface, with the second ratio being greater than the first ratio. Thus, there is a higher density of contact surface in the second area than in the first area. This effectively increases the polishing rate at the second area relative to the rate at the first area.

Those skilled in the art will recognize that macrogrooves are absent in the polishing pads employed in conventional CMP systems, while in polishing pads employed in modem CMP systems, macrogrooves are used for facilitating slurry flow across the polishing pad surface and not for reducing the polishing pad surface.

Figure 2A:
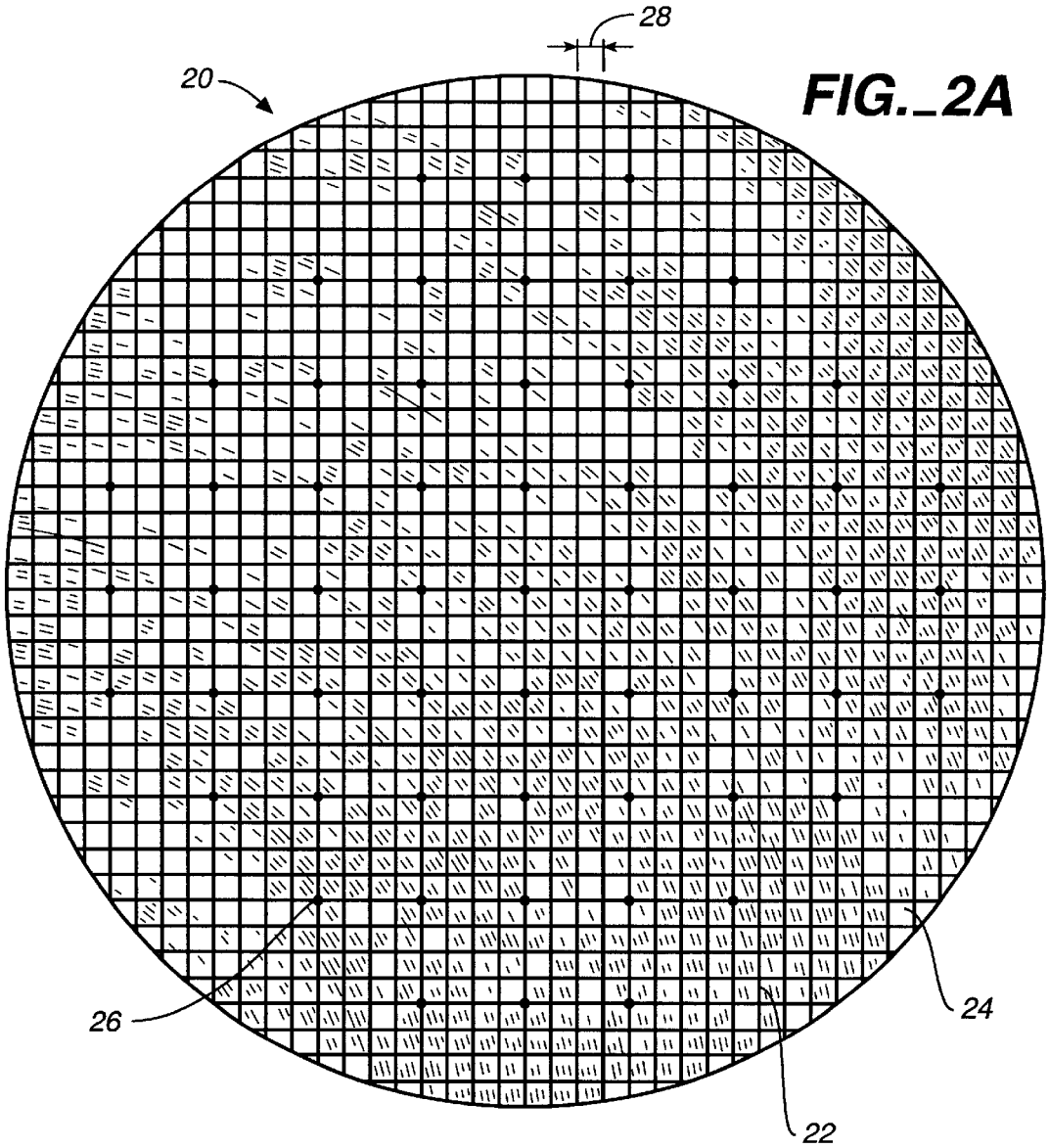
FIG. 2A shows a front view of a polishing pad employed in modem chemical-mechanical polishing (CMP) systems.
Figure 3A:
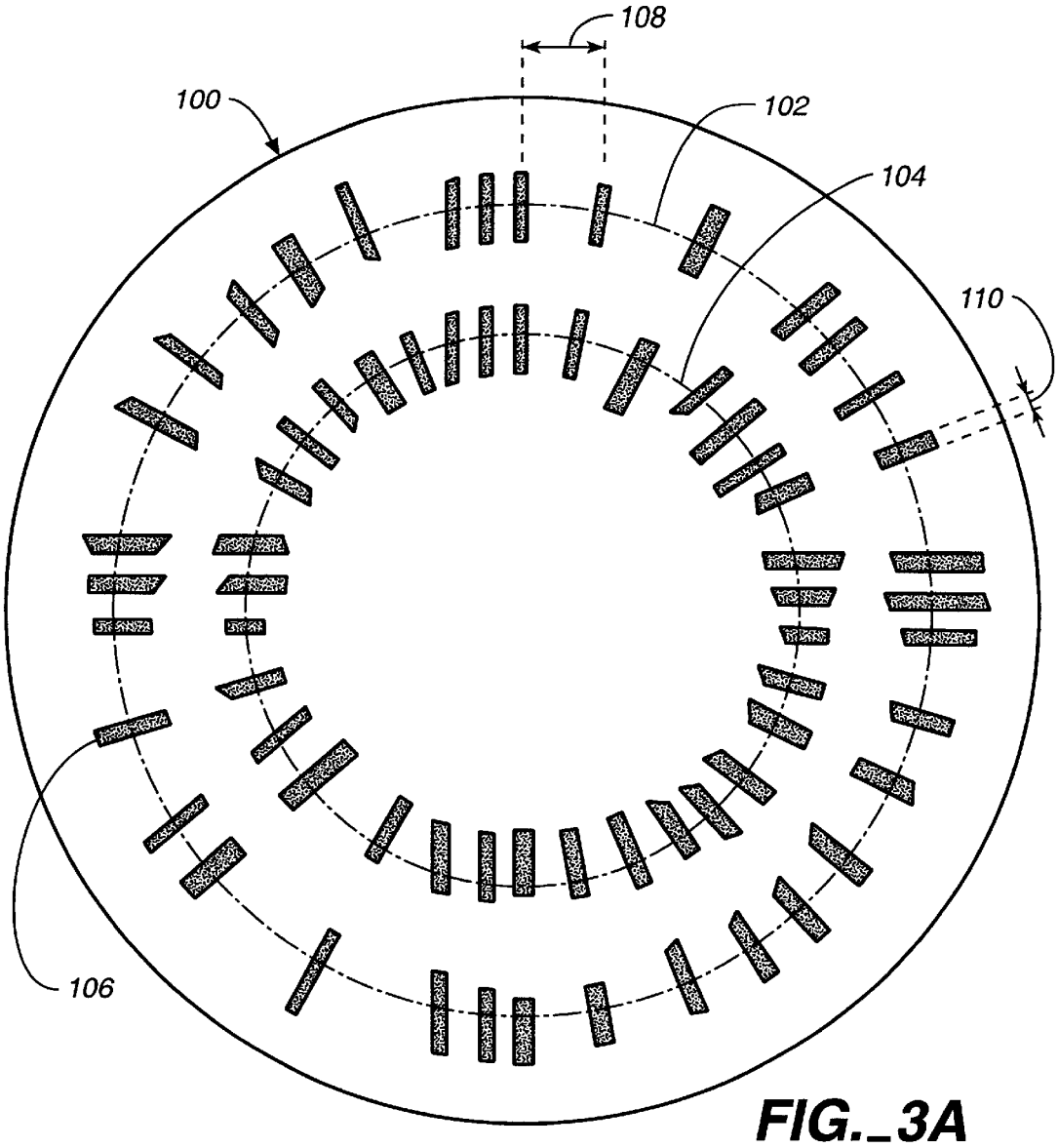
FIG. 3A shows a surface of a modified polishing pad, according to one embodiment of the present invention, preferably employed in a conventional CMP system and having macrogrooves that extend radially at the inner and outer boundaries of a wafer track.

FIG. 3A shows a modified polishing pad 100, according to one embodiment of the present invention, that is preferably employed in conventional CMP systems, such as the Avanti 472 mentioned above. The amount of contact area exposed at the edges of a wafer track area, e.g., the inner and outer boundaries, is reduced in this embodiment by the presence of grooves at the inner and outer boundaries of the wafer track. As shown in FIG. 3A, a plurality of radially extending grooves 106 are formed on an inner boundary 104 and an outer boundary 102, which boundaries define a wafer track region. Grooves 106, which have a width denoted by reference number 1 10, are spaced apart from each other by a distance 108 (referred to as "groove spacing" hereinafter). Polishing pad 100 may also include diagonally oriented microgrooves (not shown to simplify illustration) that are substantially similar to microgrooves 24 shown in FIG. 2A.

Figure 1:
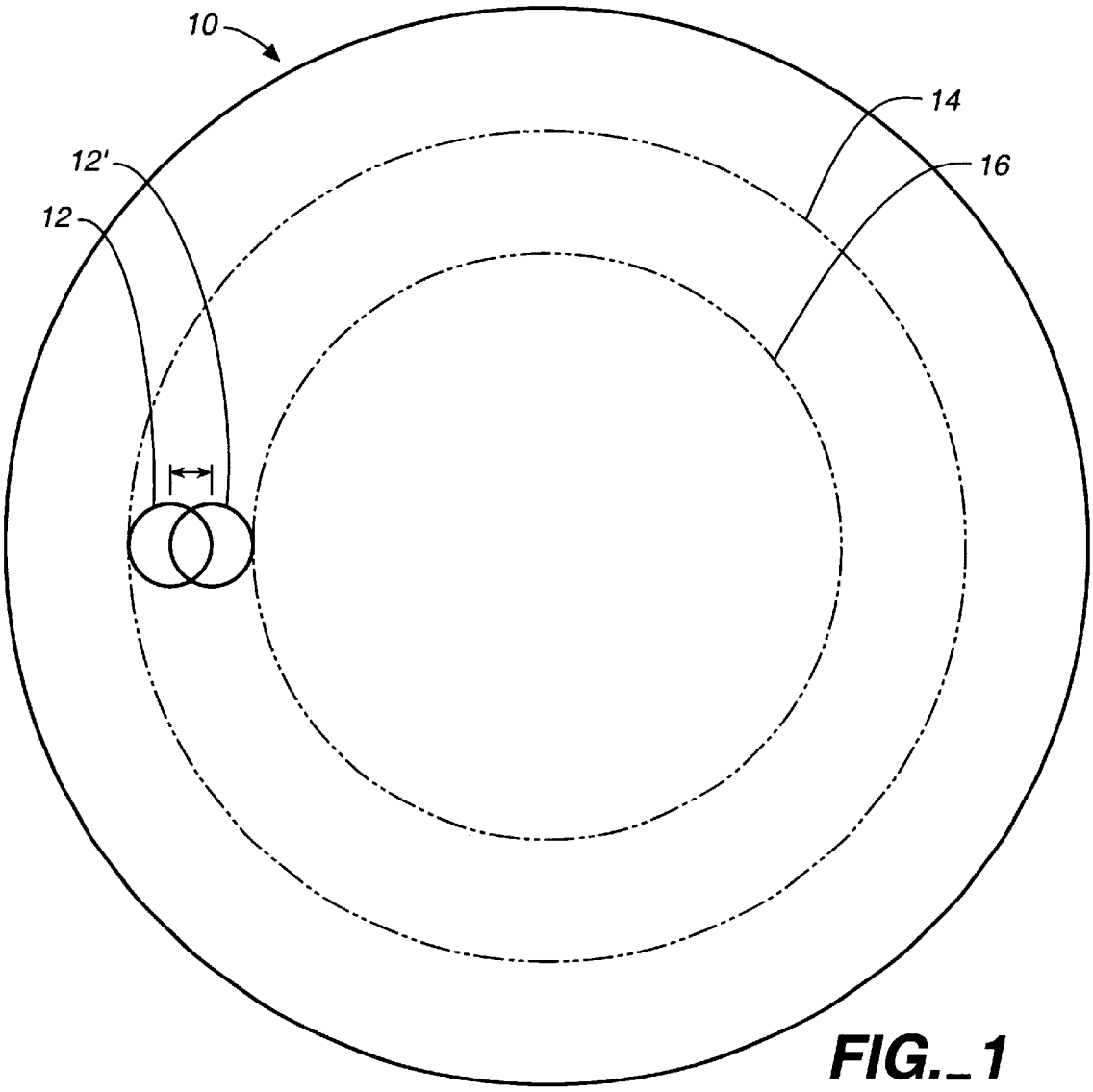
FIG. 1 shows a wafer being polished on a wafer track of a polishing pad employed in conventional chemical-mechanical polishing (CMP) systems.

Polishing pad 100 includes at least one of polyurethane, urethane, polymer, felt and filler material. Inner and outer boundaries 104 and 102 of FIG. 3A are substantially similar to inner and outer boundaries 16 and 14 of the wafer track shown in FIG. 1, except for the presence of grooves 106. The shape and dimensions of grooves 106 (including width 110) and groove spacings 108 are substantially similar to macrogrooves 22 and macrogroove spacings 28 of FIG. 2A, respectively. In one embodiment, width 110 and macrogroove spacings 108 of the present invention are substantially uniform.

The presence of grooves at the boundaries of the wafer track creates a recessed area on the polishing pad surface, which area is not exposed to substrate surface during CMP. Consequently, peripheral substrate regions that contact the wafer track boundaries having grooves during CMP are not overpolished as they are on a polishing pad without any grooves, e.g., polishing pad of FIG. 1. Thus, under center slow polishing conditions described above, the substrate surface would be uniformly polished at the center and peripheral regions of the substrate surface.

Figure 3B:
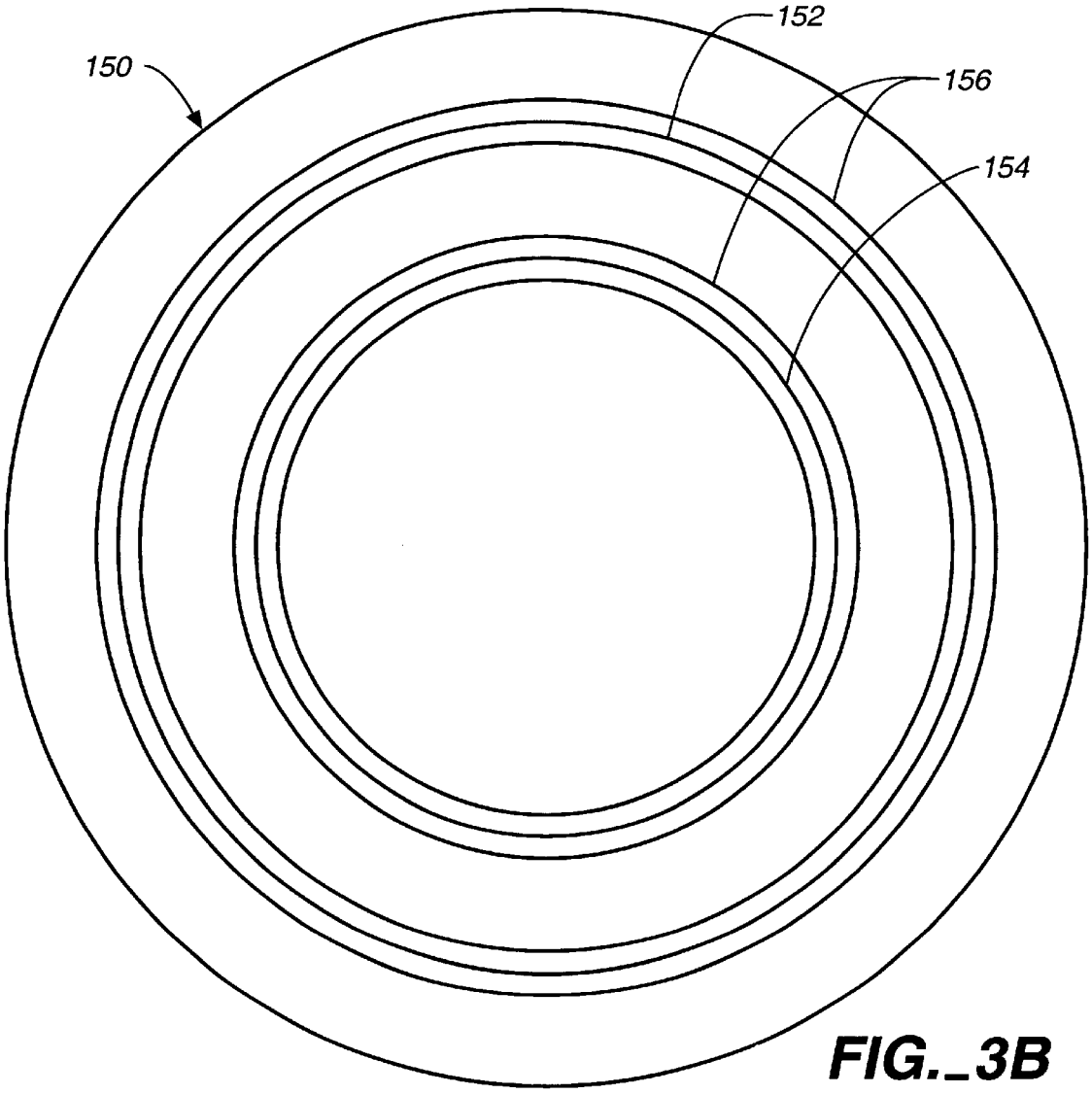
FIG. 3B shows a surface of a modified polishing pad, according to another embodiment of the present invention, preferably employed in a conventional CMP system and having macrogrooves that are formed in a circular configuration at the inner and outer boundaries of the wafer track.

It is important to note that grooves 106 of FIG. 3A can be arranged in other orientations. By way of example, FIG. 3B shows a polishing pad 150 where substantially circular grooves 156 are positioned at the wafer track inner boundary 154 and outer boundary 152. Circular grooves 156 have the same affect on the substrate surface during CMP as grooves 106 shown in FIG. 3A.

Figure 4A:
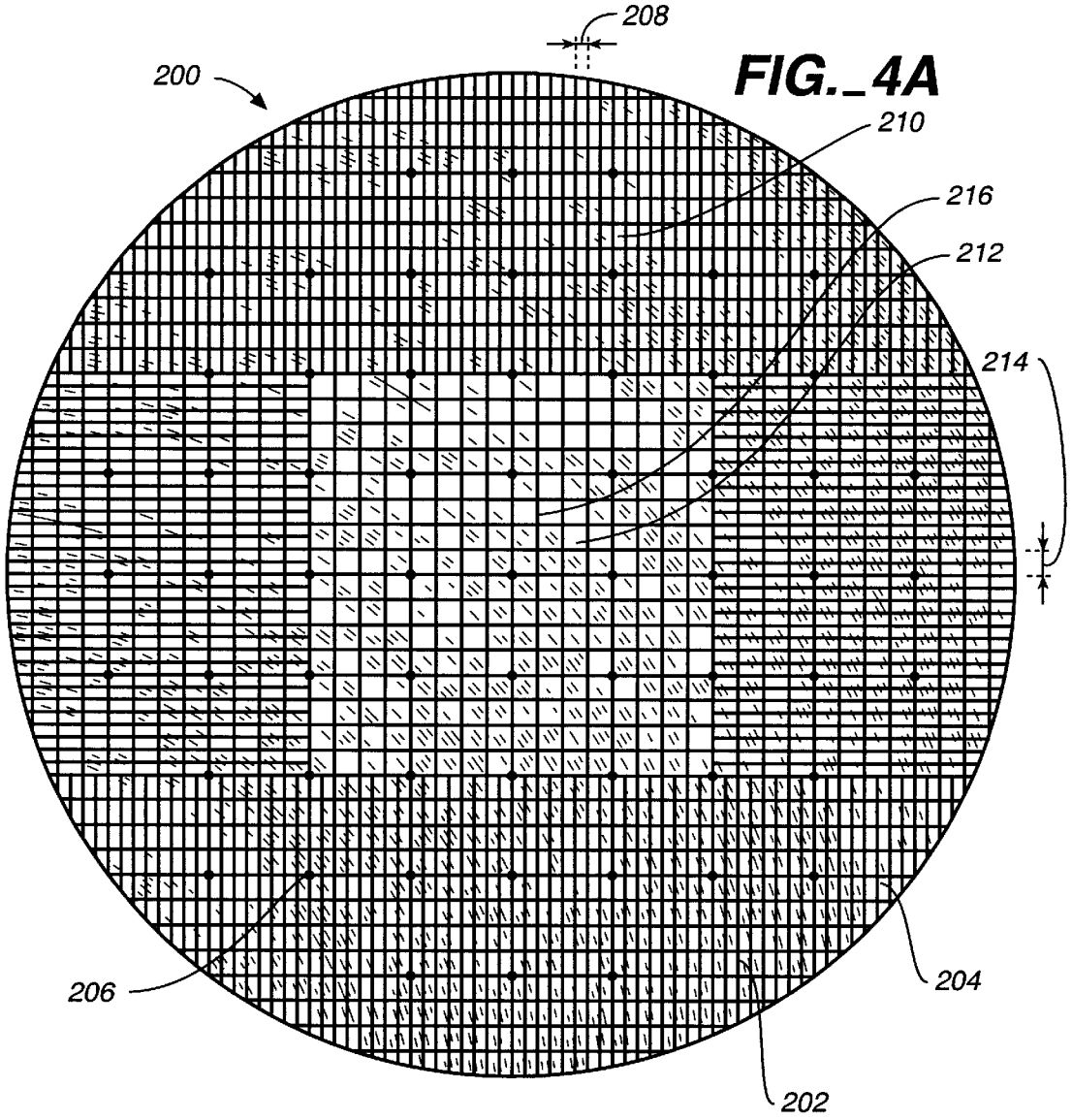
FIG. 4A shows a surface of a modified polishing pad, according to yet another embodiment of the present invention, preferably employed in a modem CMP system and having a contact area with narrower macrogroove spacings than another contact area of the polishing pad.

According to the present invention, the modifications to the polishing pad in the modem CMP systems, where macrogrooves are already present on the polishing pad to facilitate slurry flow, include providing a contact area having narrower macrogroove spacings or wider macrogrooves relative to another contact area. By way of example, FIG. 4A shows a polishing pad 200, according to one embodiment of the present invention, preferably employed in modem CMP systems and having a first area 210 disposed outside a center area of polishing pad 200 with narrower macrogroove spacings than a second area 212 that is located at a center area of the polishing pad. A plurality of slurry injection holes 206 and microgrooves 204 are substantially uniformly disposed throughout the surface of polishing pad 200.

Second area 212 has macrogrooves 216 formed thereon and these macrogrooves are spaced apart by a distance shown as macrogroove spacing 214. First area 210 has macrogrooves 202 formed thereon and these macrogrooves are spaced apart by a distance shown as macrogroove spacings 208. As mentioned above, macrogroove spacing 208 is narrower than macrogroove spacing 214 or in other words, less macrogrooves per square area are present in second area 212 than in first area 210. As a result, the first area has more macrogroove recessions that are not exposed to the substrate surface than the second area. During CMP, a peripheral region of the substrate surface that contacts first area 210 is exposed to and contacts a smaller amount of polishing pad surface area than a center region of the substrate surface that contacts second area 212. Under slow center polishing conditions described above, this is desirable because the center region is polished to the same extent as the peripheral region of the substrate surface to produce a more uniformly polished substrate surface.

Macrogroove spacing 214 may generally be substantially the same as macrogroove spacing 28 of FIG. 2A. By way of example, macrogroove spacing 214 may be between about 5 and about 8 mm. Narrower macrogroove spacing 208, however, may generally be between about 3 and about 5 mm and preferably be between about 3.5 and about 4.5 mm.

Figure 2B:
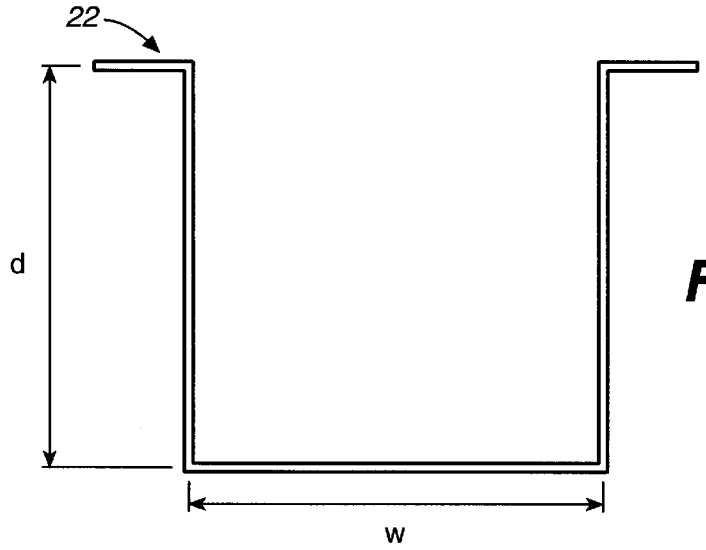
FIG. 2B shows a cross-sectional view of a macrogroove of FIG. 2A.
Figure 2C:
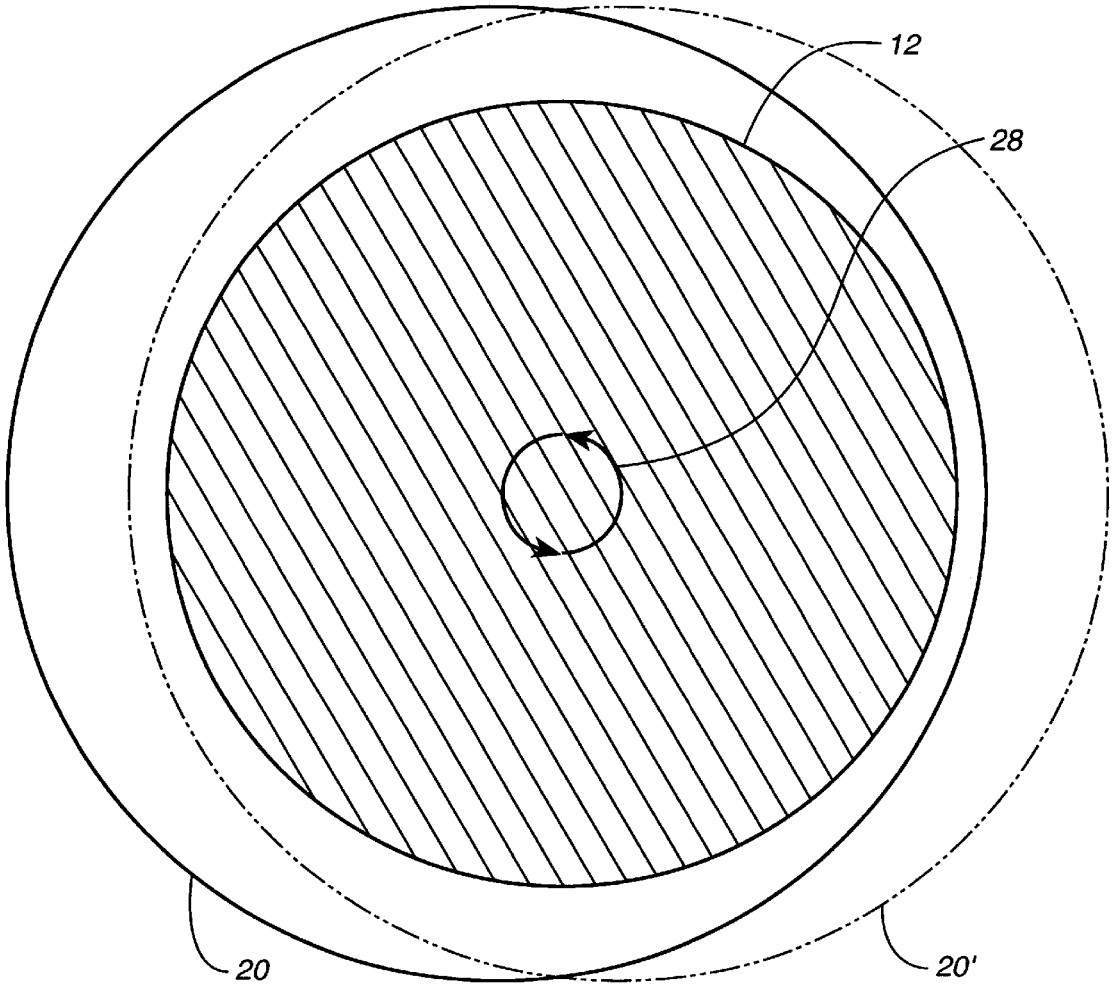
FIG. 2C shows the wafer being polished on a center region of the polishing pad of FIG. 2A.
Figure 4B:
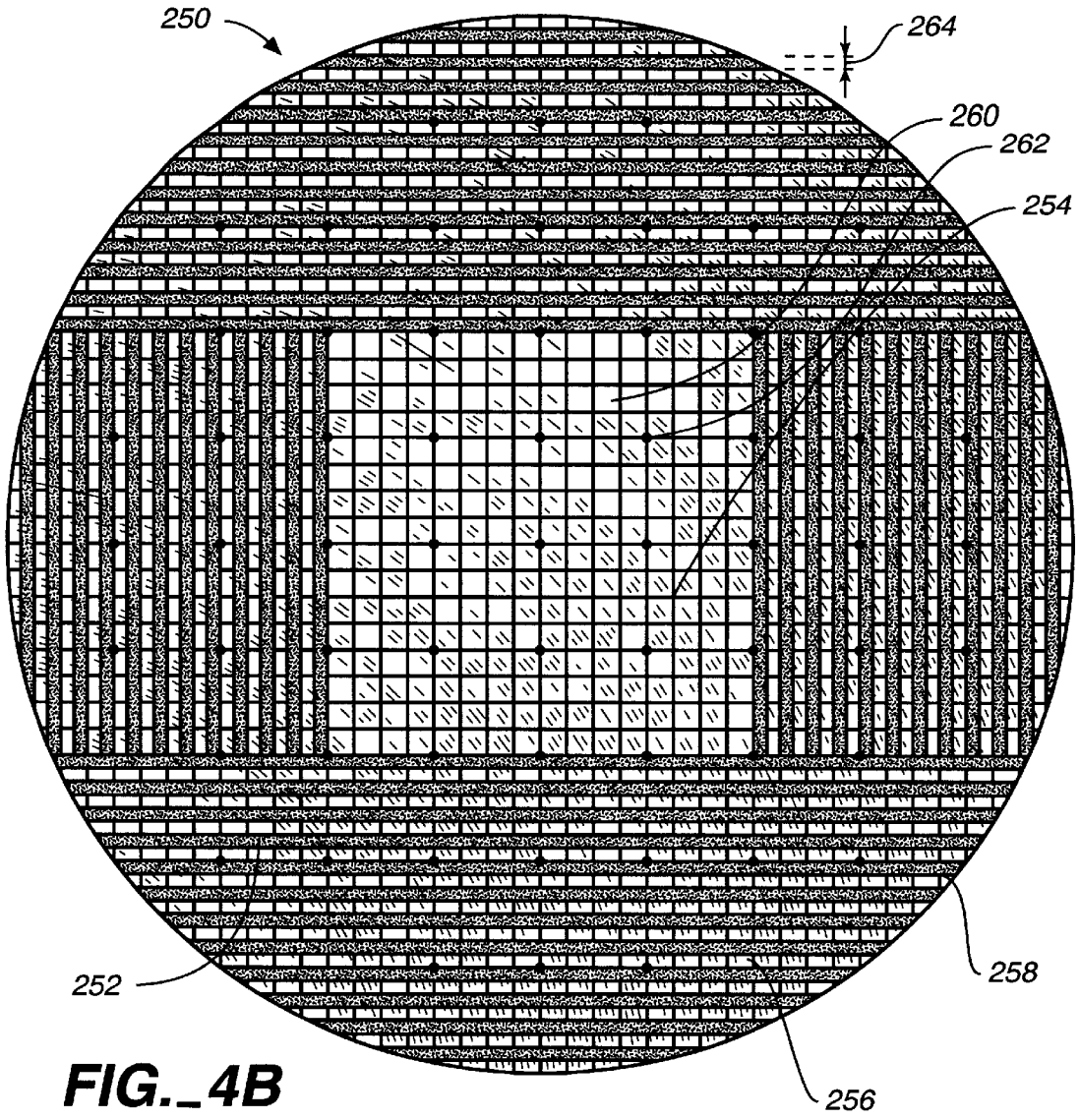
FIG. 4B shows a surface of a modified polishing pad, according to yet another embodiment of the present invention, preferably employed in a modern CMP system and having a contact area with wider macrogrooves than another contact area of the polishing pad.

Alternatively, a contact area of the polishing pad surface exposed to the substrate surface can be reduced by widening the macrogrooves in that area. FIG. 4B shows a polishing pad 250 having a first area 252 having wider macrogrooves 258 than macrogrooves 260 of a second area 254. In this embodiment, the width of macrogrooves 260 may generally be substantially the same as the width "w" of macrogroove 22 of FIG. 2B and preferably be between about 0.8 and about 1 mm. The width of macrogroove 258 which is shown by reference number 264 is, however, relatively wider. The width of macrogroove 258 may generally be between about 1 mm and about 2 mm and preferably be between about 1.2 and about 1.6 mm. Slurry injection holes 262 and microgrooves 256 are distributed substantially uniformly throughout the first and second contact areas.

Figure 5:
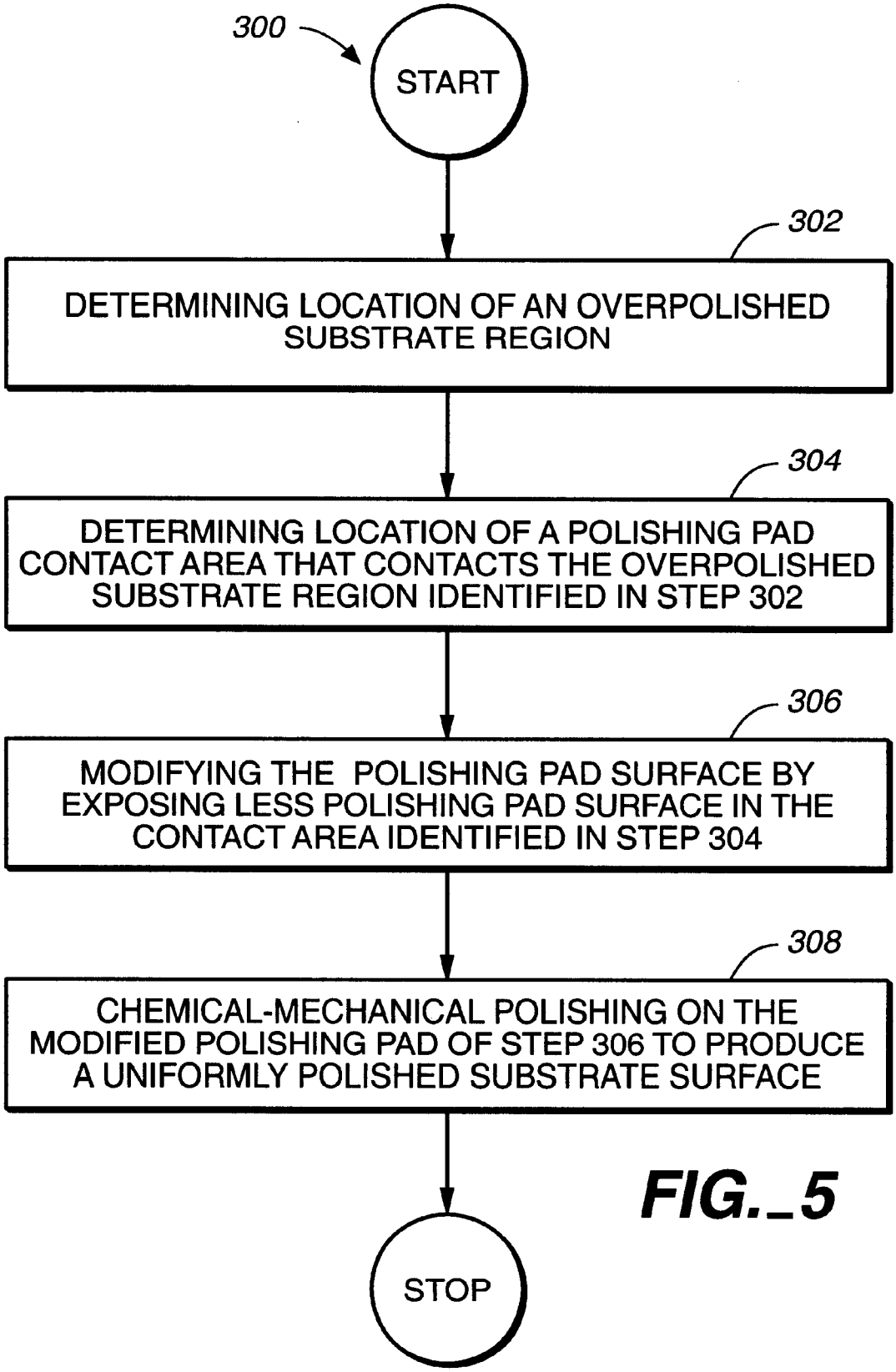
FIG. 5 shows a process of producing a more uniformly polished substrate surface, according to one embodiment of the present invention.

FIG. 5 shows a.process 300, according to one embodiment of the present invention, for producing a uniformly polished substrate surface. Process 300 is preferably implemented to combat the non-uniform film removal rate produced due to "center slow" polishing.

Process 300 begins at a step 302, in which the location of overpolished substrate region is determined. Under center slow polishing conditions, the peripheral region of the substrate surface is typically overpolished. In other cases, step 302 is carried out by examining the polished substrate surface under visual inspection systems, such as microscopes, scanning electron microscopes (SEMs) and automatic machines well known to those skilled in the art. Of course, in this step, more than one as opposed to a single overpolished region on the substrate surface may be identified and polishing pad areas that produce such overpolished substrate regions may be modified (as described below) collectively in a single step.

Next, in a step 304, a location of a polishing pad contact area that produced the overpolished substrate region of step 302 is determined. In the polishing pad employed in IPEC 676, for example, an area outside the center area of the polishing pad surface produces the overpolished peripheral substrate surface region. In the polishing pad employed in IPEC 472, areas about the wafer track boundaries produce an overpolished peripheral substrate surface region.

In a step 306, the contact area determined in step 304 is then modified, e.g., by either introducing macrogrooves or by placing wider macrogrooves or macrogrooves with narrower spacings on the contact area. In this step, these modifications may be carried out using conventional techniques well known to those skilled in the art, such as by skiving a portion of the polishing pad using a router blade, for example, to form macrogrooves. By way of example, grooves are formed on the polishing pads employed in the IPEC 472, as shown in FIGS. 3A and 3B. As another example, additional macrogrooves are formed to shorten macrogroove spacings on the polishing pads employed in the IPEC 676, as shown in FIGS. 4A and 4B, respectively. Thus, the contact area modified according to the present invention has a smaller amount of polishing surface exposed to the substrate surface during CMP.

Finally, in step 308, either the substrate surface with the overpolished region or another substrate is subjected to CMP on the modified polishing pad of step 306 to produce a more uniformly polished substrate surface. It is important to note that the polishing pad modified according to the present invention polishes at a lower rate the overpolished substrate surface regions or regions of the substrate surface that would be overpolished in the currently employed polishing pads to produce a more uniformly polished substrate surface.

The present invention represents a marked improvement over the conventional polishing pad design. By way of example, as mentioned above the modified polishing pad design of the present invention produces a more uniformly polished substrate surface, which translates into a higher yield for the polished substrates. As another example, the modified polishing pad design of the present invention prolongs the polishing pad life and therefore reduces the significant replacement cost of the polishing pads.

Although the foregoing invention has been described in some detail for purposes of clarity of understanding, it will be apparent that certain changes and modifications may be practiced within the scope of the appended claims. For example, while the specification has described modifying the polishing pad surface in the context of chemical-mechanical polishing, there is no reason why in principle polishing pads used in other polishing applications cannot be modified similarly. As another example, the background section describes a semiconductor wafer as a substrate, but there is no reason in principle why substrate of the present invention cannot include other integrated circuit substrates, optical substrates, magnetic media substrates, etc. Therefore, the present embodiments are to be considered as illustrative and not restrictive, and the invention is not to be limited to the details given herein, but may be modified within the scope of the appended claims.

What is claimed is:

1. A process for chemical mechanical polishing a surface comprising:

providing a polishing pad having a surface including an annular region in the polishing pad interior defining a wafer track having an inner boundary and an outer boundary;

a first set of grooves located at the wafer track inner boundary;

a second set of grooves located at the wafer track outer boundary; and an area of the wafer track between the inner and outer boundaries, having no grooves; and polishing the substrate surface by rotating the substrate surface against the surface of the polishing pad.

2. A polishing pad designed for chemical mechanical polishing of a substrate surface, the polishing pad having a surface with an annular region in the polishing pad interior defining a wafer track having an inner boundary and an outer boundary, the polishing pad comprising:

a first set of grooves located at the wafer track inner boundary;

a second set of grooves located at the wafer track outer boundary; and an area of the wafer track between the inner and outer boundaries, having no grooves.

3. The polishing pad of claim 2, wherein the grooves of the first and second sets have widths of about 1 mn.

4. The polishing pad of claim 2, wherein the grooves of the first and second sets have spacings of between about 5 and about 6 mm.

5. The polishing pad of claim 2, wherein the polishing pad is made from at least one of polyurethane, urethane, polymer, felt or filler material.

6. The polishing pad of claim 2, further comprising microgrooves.

7. The polishing pad of claim 2, further comprising slurry injection holes.

8. The polishing pad of claim 2, wherein the grooves of the first and second sets extend radial direction with respect to the polishing pad.

9. The polishing pad of claim 2, wherein the grooves of the first and second sets are oriented in a configuration.

10. The polishing pad of claim 2, wherein the grooves of the first and second sets have uniform spacings.

* * * * *